United States Patent [19]

Niems

[11] Patent Number: 4,826,429

[45] Date of Patent: May 2, 1989

[54] APPARATUS FOR UNIFORMLY COOLING PYROPROCESSED PARTICULATE MATERIAL

[75] Inventor: Lee H. Niems, Flossmoor, Ill.

[73] Assignee: Kennedy Van Saun Corporation, Danville, Pa.

[21] Appl. No.: 144,186

[22] Filed: Jan. 15, 1988

Related U.S. Application Data

[62] Division of Ser. No. 944,972, Dec. 22, 1986, Pat. No. 4,728,288.

[51] Int. Cl.[4] ..... F27D 15/02

[52] U.S. Cl. ..... 432/78; 432/80

[58] Field of Search ..... 432/78–80, 432/67, 69, 77

[56] References Cited

U.S. PATENT DOCUMENTS

| | | | |
|---|---|---|---|
| 2,858,123 | 10/1958 | Niems | 432/78 |
| 3,578,297 | 5/1971 | Niems | 432/80 |
| 4,076,493 | 2/1978 | Gardner | 432/78 |
| 4,624,636 | 11/1986 | Willis | 432/78 |
| 4,732,561 | 3/1988 | Eiring et al. | 432/78 |

*Primary Examiner*—Henry C. Yuen

*Attorney, Agent, or Firm*—Charles F. Schroeder

[57] ABSTRACT

Apparatus for cooling a bed of pyroprocessed particulate material such as lime received from a source such as a kiln, the cooler including a shaft with one or more underlying hoppers through which the material flows as cooling air is forced upwardly therethrough. The invention embodies hoppers with uniform slopes at any given elevation, dual hopper slopes with one being extremely steep, internal flow guiding means, as well as an octagonal or partially octagonal wall configuration and matching scalloped octagonal hoppers. Also included is the concept of providing substantially equal areas of draw in any angular segment about the vertical center line of discharge from a hopper or cluster of hoppers. The resultant is more uniform flow of material down through the cooler and correspondingly more efficient cooling. Alternative embodiments include hopper transition pieces in lieu of the cooling shaft being constructed in an octagonal or partially octagonal configuration.

10 Claims, 3 Drawing Sheets

APPARATUS FOR UNIFORMLY COOLING PYROPROCESSED PARTICULATE MATERIAL

This application is a division of application Ser. No. 944,972, filed Dec. 22, 1986, now U.S. Pat. No. 4,728,288.

FIELD OF THE INVENTION

The invention relates to apparatus for cooling of pyroprocessed particulate material such as lime, dead-burned dolomite, lightweight aggregate, Kaolin, and cement clinker or other products herein exemplified by calcined lime pebbles such as are produced from limestone heat-produced in a kiln. The term particles as used herein includes large and small pieces, pebbles, granules, broken solids, fragments, clinkers, etc. By way of example, lime particles processed in the apparatus of the invention herein described may range in size from dust less than 60 mesh to over 2 inches in size and to much larger sized particles or agglomerates and kiln coating rejected from the cooler by means of grates.

Limestone is typically calcined in a kiln, such as a generally horizontal but slightly inclined rotary kiln, heated by one or more burners which subject the charge to flame temperatures in the order of 2800° F. The heated lime exited from the kiln is passed through a grate and deposited in a particle bed of a cooling unit such as in a shaft type cooler. The cooling bed in such a cooler has its deposition surface overlying one or more hoppers through which the mass of particles flow downward to the cooler exit region. Air for cooling the particles is passed upwardly under pressure through the bed in counterflow relation to the generally downward mass flow of particles. The temperature of the lime is reduced in the unit to a level which permits subsequent conveying and storage as well as shipment of the material.

PRIOR ART

Cooling of heated pieces of lime and other materials has been accomplished successfully in shaft type coolers such as are disclosed in my U.S. Pat. Nos. 3,578,297, 3,721,017, 3,731,398 and 4,123,850 as well as earlier U.S. Pat. Nos. 2,858,123, 2,901,837 and 2,970,828. These coolers are all within the classification of shaft type coolers wherein material is received continuously in a bed directly from the kiln and then is moved gradually downwardly to the cooler exit as cooling air is passed upwardly therethrough to cool the material. The material being cooled resides in the bed for a period typically in the order of $\frac{3}{4}$ to $1\frac{1}{2}$ hours to provide the necessary time for heat transfer from the particulate matter to air passing up therethrough. The cooling air is introduced under pressure into the downwardly moving mass of particles from a lower region and is caused to flow in counterflow relation upwardly through the mass. The heated air exiting from the upper region of the bed is used in the system as preheated air for combustion. In some cases, a portion of the preheated air is also used to dry pulverized coal used as fuel for the system.

THE PROBLEM

Such prior art cooler structures include in combination one or more adjacent hoppers, usually a cluster of four, in the lower portion of the cooler within the boundaries of a square or rectangular refractory lined shaft which extends upwardly to a plenum-like firing hood at the discharge end of the kiln from which pyroprocessed material is exited and introduced into the cooler. The hoppers in such coolers heretofore have usually been of generally square or rectangular configuration in plan view at the top to permit matching with the refractory wall configuration of the shaft extending above the hoppers to the firing hood at the discharge end of the kiln. The square hoppers each have four side walls joined at corners which results in a valley slope at the corners of the square hoppers which by its nature is significantly shallower in angle to the horizontal than the angle of the side wall portions leading more directly down to the outlet. The particulate material in such a hopper thus is caused to flow downwardly at different rates depending upon which region of the hopper the material is located. A substantial difference in the rate of descent of particles occurs in the vicinity of the valleys versus the rate of descent in the vicinity of the sides.

It is therefore an object of the present invention to provide a hopper design in which all sides at each cross-sectional level have the same slope to thereby eliminate or minimize differentials in particle draw rate throughout the cross-section at each level of the cooler.

Another characteristic of existing coolers is that the areas to be drawn in each 90°, 45°, $22\frac{1}{2}$° or other segment about the center in plan of the cooling zone area above each hopper and in the hopper are substantially different in size resulting in substantial difference in the draw rates of these areas.

Existing coolers of the above designs are consequently typically oversized at a significant cost in an unsuccessful effort to overcome these problems which result in an inability to achieve a uniform distribution of air and particle mass in the coolers. Such oversized cooler designs perform to an acceptable degree as long as the total air/product (A/P) ratio can be high enough so that a significant amount of product does not pass through the cooler with an A/P less than one. If, however, a significant amount of product does pass through the cooler with an A/P ratio less than one, that portion will be discharged at an excessive temperature, for example 1200° F. depending on how low the A/P ratio is, even though the balance of the product is at acceptable temperatures such, for example, as within 50° F. of ambient.

Tests in existing shaft type cooler designs have shown for example that in range of 25% of the total cooler cross-section would draw down at an average rate at least twice that of the remaining 75%. The resultant imbalance in A/P ratio from this factor is such that if the total average A/P is less than 1.75/1, the 25% that is drawing at the faster rate must be at A/P less than 1/1. This results in high discharge temperatures and lowered recuperative efficiency, unless relative air flows can be made to compensate, and this has been found to be difficult or impossible to do. As the total average A/P ratio is forced lower to satisfy more modern and efficient kiln system requirements it is mandatory that the imbalance in draw be minimized. By way of example, if a total average of 1.3/1 A/P ratio is necessary, the maximum acceptable imbalance in 25% of the bed could be only 1.4 times the draw rate of the other 75% of the bed.

It is therefore another object of the invention to provide a shaft type cooler design in which each unit mass of particulate product will be contacted, as nearly as possible, by the same proportionate amount of cooling air as all other unit masses of product to effect discharge of the product at a uniform acceptable temperature throughout.

Present industry trends toward use of more efficient preheater kilns, kiln insulation, internal heat exchangers and proportionately larger coal mills requiring a greater amount of ambient air, all reduce the amount of air available for recuperative cooling. It is highly desirable therefore that the cooler design be such that it promotes uniformity of flow of both air and product. The lower the A/P ratio that it operates under, the more important it becomes that the cooler provide such uniformity in distribution of air and product.

It is thus another basic object of the invention to provide a shaft type cooler capable of recuperating approximately 95% or more of the sensible heat in the product discharged from a kiln while cooling the product to temperatures within 50° of ambient, and while using an A/P ratio in the range of 1.3/1 or less, which is substantially lower than has been heretofore successfully possible in such shaft type coolers.

Additional objectives of the invention thus are economy of size, reduced blowback of fines and lower power requirements all of which are possible with the design of the present invention.

The product exiting from the kiln is cooled from a temperature generally in a range of from 1500° F. to 2400° F. to a temperature low enough to permit its further processing such as transporting the material on a rubber conveyor belt, or oiling when the material is dead burned dolomite, or packing in paper bags. In so cooling the material it is an objective to recuperate as much of the sensible heat in the product as possible, and to return this heat to the process in the form of preheated air for combustion or for a coal pulverizer if used. Such recuperated heat has an effect on total fuel consumption that may range, in the case of lime, up to three or more times its apparent value so that the recuperative efficiency of the cooler thus has a significant affect on product fuel cost for all products cooled and a particularly significant affect on the fuel cost of burning lime.

Another basic objective is to accomplish the cooling and recuperation using only the limited amount of air that can be reutilized in the combustion process. It is of further importance that the cooler design allow air to be passed through the bed with a minimum air blowback of fines and economically acceptable levels of power consumption. Power and blowback of fines vary exponentially with the area of the cooler bed cross section for a given product rate. Proportionate larger sections operate with less power and blowback but present greater difficulty in attaining uniformity of distribution of air and product. An increase in cross section also requires an increase in the height to achieve product distribution into the cooler and withdrawal from the cooler which commensurately increases the cost of components and installation.

INTRODUCTORY DESCRIPTION AND FEATURES OF THE INVENTION

Regardless of the overall geometric limitations which may be imposed by a square or rectangular shaft and plenum superstructure at the discharge end of a kiln, the present invention makes it possible to incorporate therein a circular generally conical shaped hopper having a uniform steep angled wall in its upper portion and a uniform shallower angled lower conical section leading to the discharge opening for the hopper.

As the steepness of the wall angle increases, the draw rates become more uniform across the section with less differences occurring in different zones because of the lesser influence the slopes have on flow within the hopper. The conical shape of the hopper provides a uniform angled side wall downward for all particles. The steeper the slope of the side wall of the hopper, the greater is the assurance that the particles therein will flow at uniform rates throughout the cross-section at each level of the hopper. But vertical space and cost limit the height, and correspondingly the steepness of the sidewall angle. That is, if the hoppers are made with steep sides approaching 90° orientation to achieve an ideally uniform cross-sectional descent of particles, the vertical height requirement would be more than available space and economic feasibility would permit.

Existing coolers in general, as explained above, have been designed with square hoppers having shallow slopes. In such hoppers the side wall angles are too low and lack the uniformity necessary to achieve a sufficiently uniform descent of particles for successful recuperation of heat at other than A/P ratios typically in the range of 1.7/1 to over 2/1.

A slope greater than 75°±5° in the upper section of the hopper might be considered, but the improvement in uniformity of draw rates diminishes increasingly with each degree increase in slope beyond 75°. The relationship of increased height with increased slope to about 75° and slightly more is acceptable. But as the slope exceeds the range of 75°±5°, each 1° increase in slope progressively raises the height requirement toward an impractical infinite height. That is, if made significantly greater than 75° it would require that the hopper have an impractical height dimension. To meet this dilema according to the present invention, the overall hopper height is shortened by provision of a less steep angled lower section leading to the exit.

To further promote uniformity of flow and cooling, an inverted cone is provided centrally in the steep portion of the hopper or just above the hopper to force the draw to proceed down the sides rather than channel through the center. The inverted cone is mated on its under edge by a frustoconical section having a progressively diminishing diameter in its downward direction to match the angle of the shallower angled wall of the hopper, further channelling the draw of material along the walls of the hopper and toward the hopper exit.

More specifically, the dual goals of more uniform draw and conservation of height are achieved according to the present invention by designing the hoppers with two joined sections of different slopes, one with a steep angle in the range of 75°±5° in the upper active cooling zone and one a shallower angle in the range of 55°±5° in the lower discharge region.

In order to match the dual angled conical hopper and to achieve nearly equal areas in each 90°, 45°, 22½° or other angular segment of the hopper, the upper externally square or rectangular refractory shaft structure, in one form of the invention, is internally built octagonally in shape. Where a cluster of hoppers is used, a portion of an octagonal section is provided in the vertical shaft walls above and adjacent each hopper. Where the cooler incorporates either one or a cluster of such hoppers, each hopper makes a unique curvalinear intersection or vertical scalloped merged relation with a full or partial octagonal refractory structure above. In the case of a cluster, each hopper additionally makes a corresponding curvalinear vertical scalloped merged association with each adjacent hopper. Smooth uninterrupted uniform transition of particle flow is thus assured from the upper vertical refractory wall portion of the cooler shaft to the metal cone section below.

In an alternate embodiment, where retention of a square or rectangular interior walled configuration of the shaft is required such as where the greatest internal area is desired for given external dimensions and refractory thickness, the upper border of a single hopper cooler can be provided with projections arranged to extend upwardly into the corner portions of the refractory walled region of the cooling shaft to effect merger with corner portions at the same slope angle as that of the body of the steep portion of the hopper below. The projections in a sense form flow displacers to provide the desired smooth uniform transitional flow of particles from a square or rectangular shaft to the octagonal entry to the conical hoppers below. Where a cluster of four such hoppers is incorporated in the cooler, upward extensions or displacers from each hopper are provided, one for merger with an adjacent corner of the rectangular refractory shaft and two for merger with the refractory walls in the mid-region between corners of the shaft where such an extension is mated with a similar extension of an adjacent hopper. In addition, a similar upward extension is provided on each to mate with extensions of adjacent hoppers where they meet at the center of the cluster of hoppers.

As another form of this embodiment of the invention, instead of having the flow displacers extend upwardly in the cooler shaft from the hopper, they are incorporated in the refractory shaft walls in the form of triangularly faced refractory or metal segments slanted upwardly from a hopper scallop at the same angle as the upper steep slope section of the hopper. Each displacer extends upward to an apex either in the corners of the shaft or in mid-regions between corners to thereby provide a smooth transitional flow relation between the rectangular shaft and the conical hoppers below.

A feature of the invention is that each of the hoppers of a cluster at each level in the hopper and in the cooling chamber above have equal areas in all 90°, 45°, 22½° or other angular segments in plan.

Other features of the invention are improvement in recuperative cooling efficiency and the ability to operate successfully on lower air/product ratios. It promotes equal dissipation of heat from each incremental portion of the mass and lowers the temperature of the mass of particles exiting from the cooler. The lower A/P ratios result in lower total air requirement and exponentially reduces static pressure requirements. This significantly reduces fan power requirements as well as the air velocities and amount of air borne fines that might otherwise be blown back into the kiln.

Other objects and features which are believed to be characteristic of my invention are set forth with particularity in the appended claims. My invention, however, both in organization and manner of construction, together with further objects and features thereof may be best understood with reference to the following description taken in connection with the accompanying drawings.

THE DRAWINGS

Figure 4:
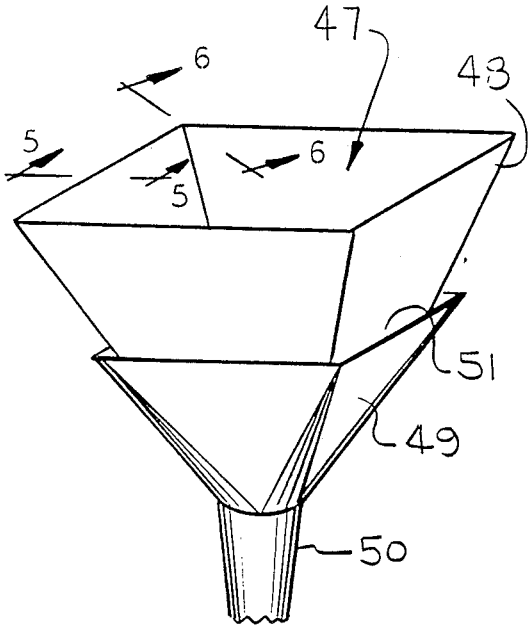
(PRIOR ART) FIG. 4
FIG. 4 is a perspective view of a conventional type square hopper illustrating the four corners leading down to the central exit therefrom.
Figure 5:
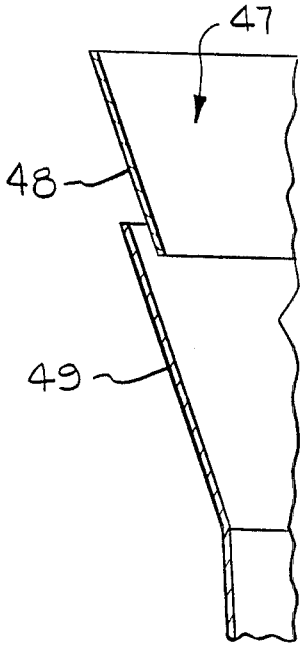
(PRIOR ART) FIG. 5
Figure 6:
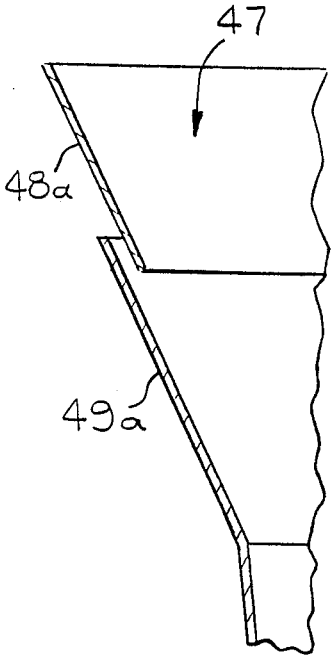
(PRIOR ART) FIG. 6

FIGS. 5 and 6 are partial cross-sectional views of the hopper of FIG. 4 as taken on lines 5—5 and 6—6, respectively.

Figure 1:
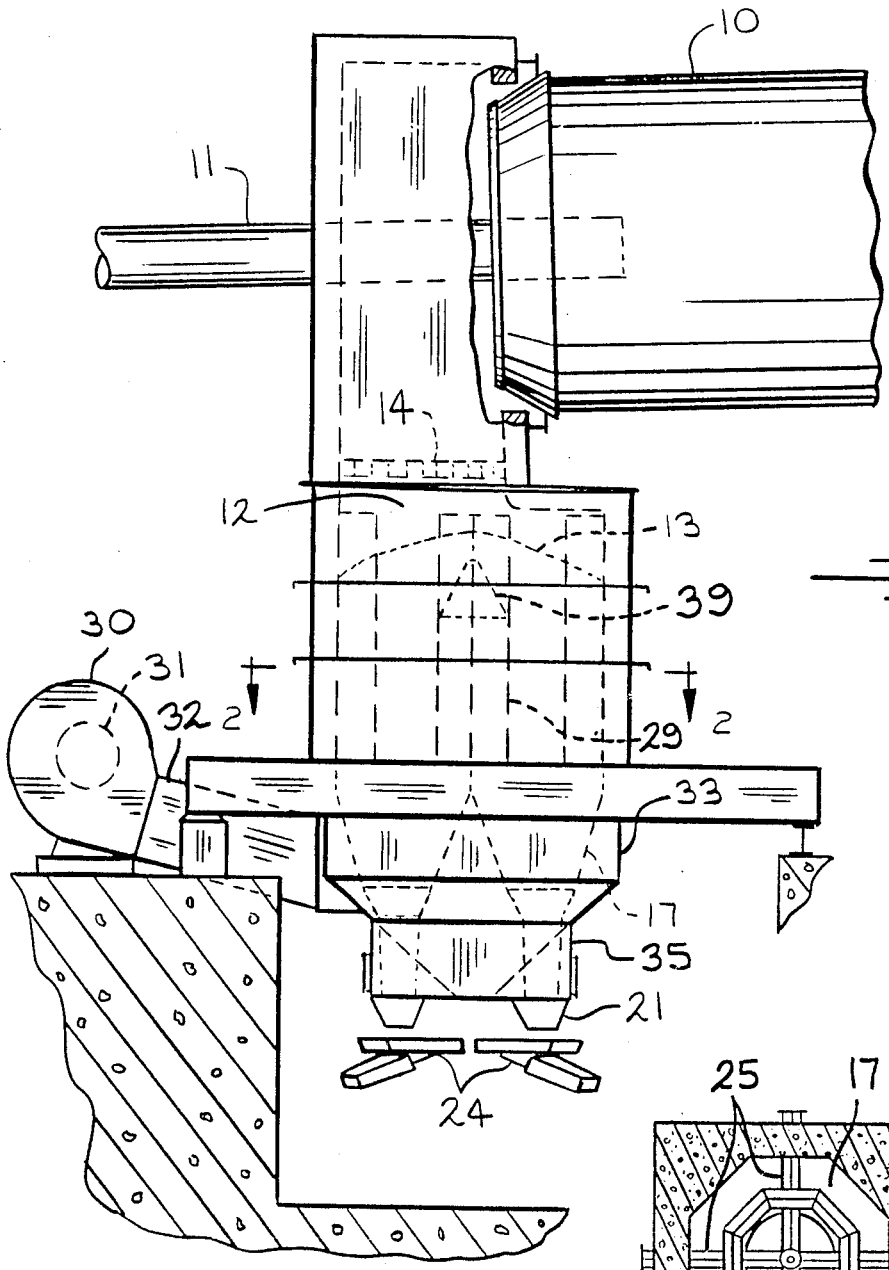
FIG. 1 is a side elevational and partially broken away view of the end portion of a kiln in operating association with an underlying shaft type cooler of the present invention.
Figure 7:
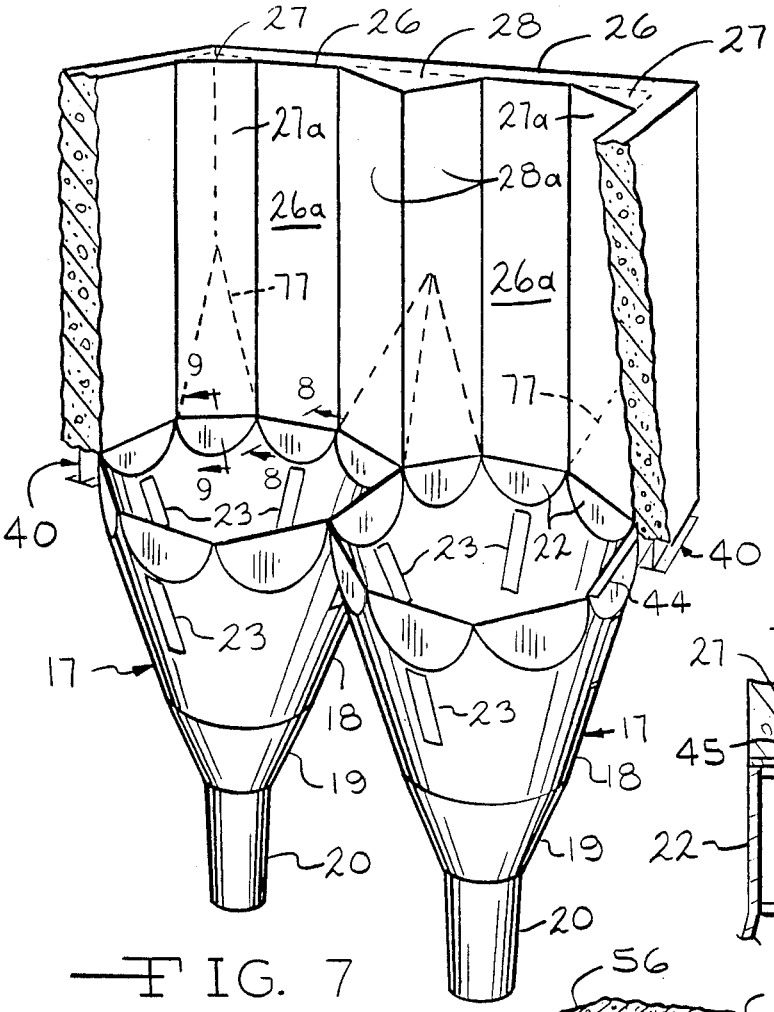
Figure 8:
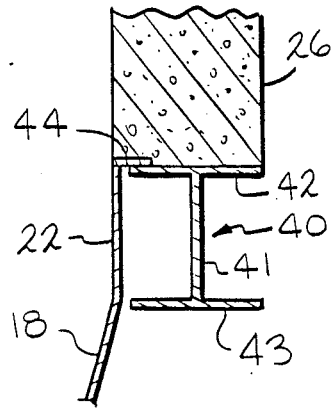
Figure 9:
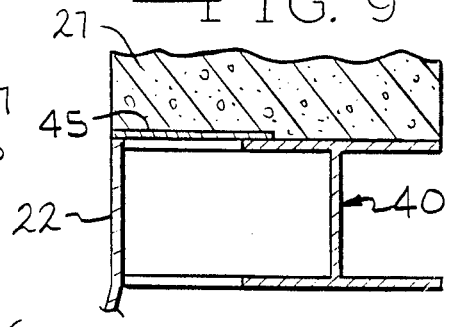
Figure 10:
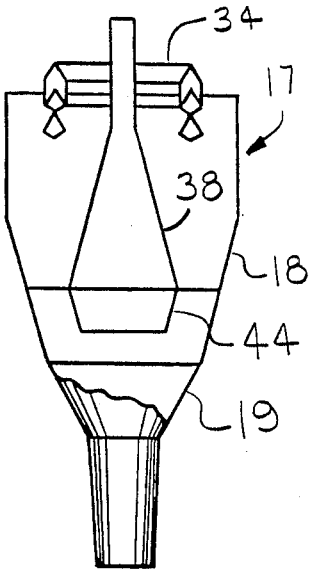

FIG. 7 is a partially broken away and partially cross-sectional perspective view of the cooler of FIG. 1 showing the assembly of two hoppers of the invention underlying the refractory portion of the cooler chamber which contain the bed of particulate material to be cooled;

FIGS. 8 and 9 are cross-sectional views of the upper border portion of one of the hoppers in FIG. 7 as taken on lines 8—8 and 9—9 respectively and FIG. 10 is a cross-sectional broken away view of a hopper of FIG. 1 showing incorporation of an inverted dispersal cone, associated frustoconical section and air louvers therein.

Figure 11:
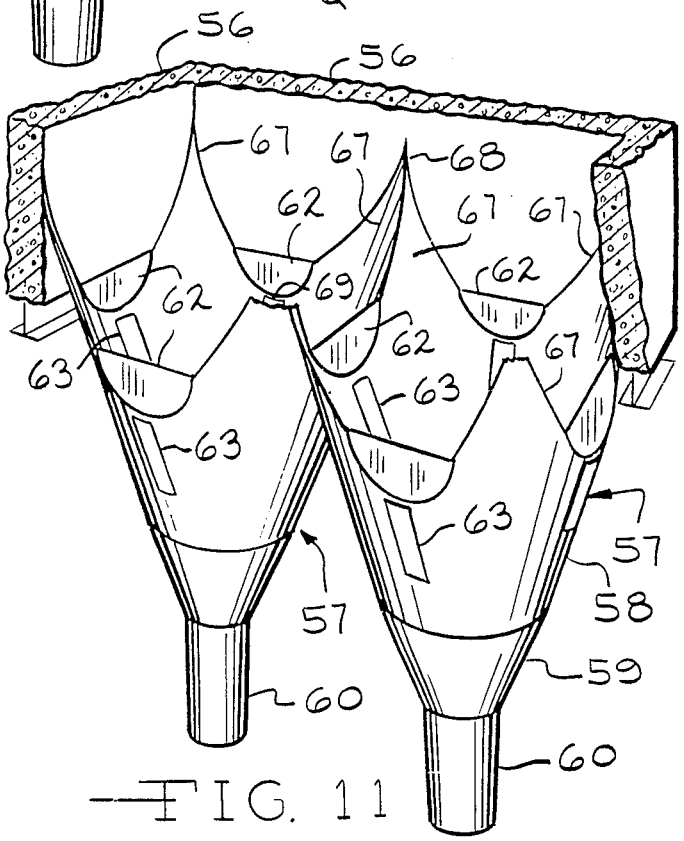

FIG. 11 is a perspective view of a pair of hoppers of a multi-hoppered cooler illustrative of another embodiment of the present invention in which the hoppers are merged with a rectangular refractory upper region by extension of the steep angled portions of the conically shaped hopper upwardly in contoured curvalinear merging relation with the right angled corners and flat side wall portions of the refractory walls.

DESCRIPTION OF THE INVENTION

Referring to the drawings in greater detail, FIG. 1 shows a general arrangement of components of a cooler at the end of a rotary kiln 10 in which limestone or other matter has been calcined or otherwise heat treated. Burner 11 is representative of one or more burners located on the discharge end of the kiln for supply of heat for calcination or other heat treatment of the charge. The kiln 10 is inclined slightly downwardly relative to the horizontal to promote discharge of its processed output by gravity into the cooler chamber 12. Prior to deposition of the product in the cooling bed 13, it is passed through an apertured grate 14 which separates large pieces of kiln coating or foreign matter from the product of acceptable size for treatment in the cooler. The material in the bed 13 moves generally downwardly and continuously into a cluster of four generally conical shaped hoppers 17 located in adjacent relation about the center of the bed as illustrated more clearly in the plan view of FIG. 2. The material flowing through the hoppers 17 is cooled by air supplied under pressure to the bed 13 by way of a plenum 33 connected by a duct 32 to a fan 30 having a main metering inlet duct 31 open to the atmosphere. The cooled material of the bed is discharged from the hoppers 17 through exit air lock standpipes 35 onto one or more feeders, such as electro vibrator feeders 24, which transfer the material to conveyor belts or to other processing stages.

Figure 2:
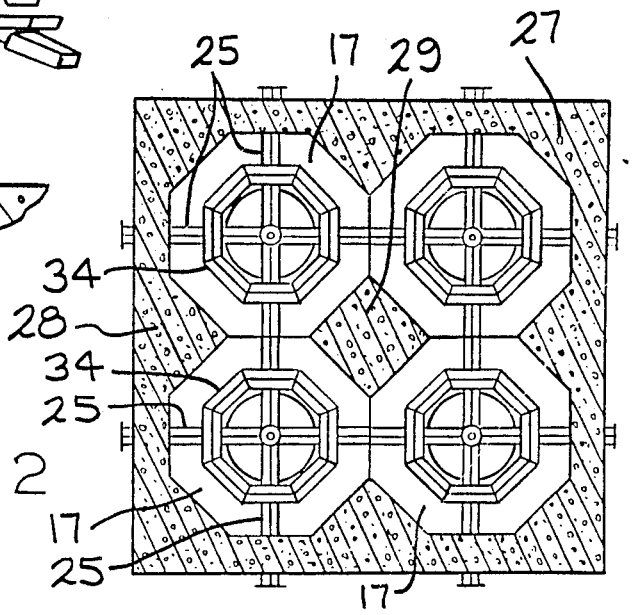
FIG. 2 is a partial cross-sectional plan view of the cooler taken on line 2—2 of FIG. 1 showing the air inlet channels to the hoppers;.

FIG. 2 illustrates the shaping of the vertical refractory walls of the cooler shaft or cooler chamber 12 into a partial octagonal cross-sectional wall portion about the top of each hopper. Each partial octagon is joined to an adjacent similar wall section with the overall assembly of such sections being arranged to accommodate a cluster of four adjacent conically shaped hoppers represented in FIG. 1. In contrast to a square cooling chamber the chamber 12 incorporates vertical faced diagonal corner segments 27 and mid-region segments 28 of isosceles cross-sectional shape, the latter of which project toward the center of the chamber to add to the desired wall segments for an octagonal shaped region above and about the top of each conical hopper 17. A central body segment 29 of square cross-sectional shape diagonally aligned rises up to assist in outlining the octagonal section for each hopper. The segment 29 additionally fills in the mid-region of corresponding cross-sectional shape formed at the center of the cluster of hoppers 17. Segment 29 extends upward to a peak 39 of suitable material either metal or refractory, just under the top center surface of the bed 13 and acts to direct the particles into regions of the chamber 12 overlying all four hoppers 17.

Air is introduced into the bed 13 residing in the partially octagonal walled cooling chamber sections through an assembly of air ducts 25 leading to ports or channels which may be in the form of octagonally configured louver forming rings 34 or other configurated louver forming rings within the bed in generally concentric relation with the cooler chamber sections and hopper outlet standpipes 35. The air input channel assemblies are each located at a level generally in the upper region of their respective hoppers 17 where they provide the cooling air flow upward in counterflow relation through hot particles moving downward through the bed 13.

Figure 3:
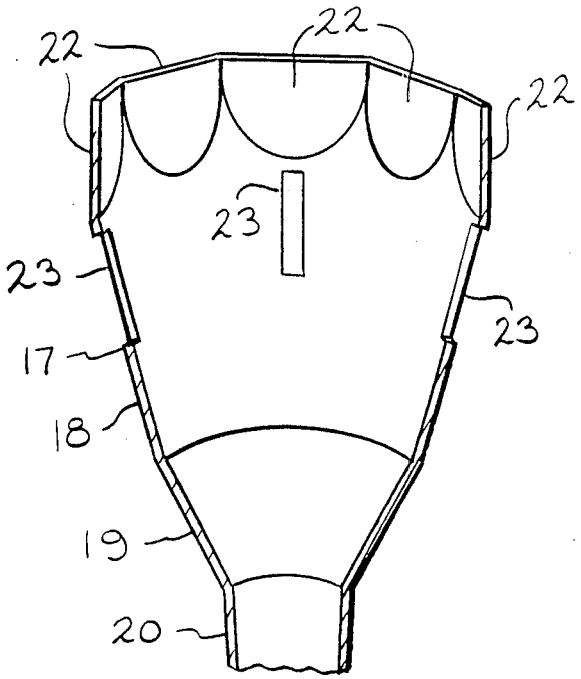
FIG. 3 is a cross-sectional side elevational perspective view of one of the hoppers of FIG. 1.

The hoppers 17, although herein referred to as conical, or generally conical in shape, are made more specifically of two frustoconical sections of different slopes joined together and provided with an outlet below. The border of the upper section is provided with a series of vertical curvalinear scallop-shaped segments each having a straight top edge aligned with the adjacent segments to form an octagonal entry. FIG. 3 illustrates in cross-section one of the dual angled conical hoppers 17 of the present invention showing its uniform steep walled (75°±5°) upper frustoconical portion or section with vertical segments 22 forming the octagonal entry and its joinder with a uniform shallower walled (50°±5°) lower frustoconical section or portion 19 leading to the exiting standpipe 20. Slot openings 23 are provided in the side of the upper section 18 for passage of air ducts 25 therethrough to which air is fed under pressure from the fan 31 for supply to the air louvers formed of the assembly of channel rings 34.

Where the steep walled portion 18 of each of the hoppers 17 angles upward it merges with the flat internal faces 26*a*, 27*a*, and 28*a* of the vertical walled cooler chamber formed of four partially octagonally shaped sections. The intersection of the upper border of the inclined curved wall of the hopper with the flat faces of the shaft 12 is in the form of a series of flat curvalinear scallop shaped sections matched in the upper marginal or border portion of the upper by scallop segments 22. The scallop segments 22 are of metal welded or otherwise suitably incorporated in the upper marginal region of the hopper and each merges with a side wall face portion of the octagonally shaped cooling chamber 12 as shown. Because of tendencies of hoppers in general to draw more rapidly in the center sections, it has been found that an inverted conical distributor or dispersal cone 38 centrally located in the hopper as shown in FIG. 10 promotes a more uniform draw. The converging wall 18 of the hopper and the diverging wall of the dispersal cone 38 provide, in a sense, an annular funnel for the bed of material contained in the hopper. That is, the material is drawn inwardly by wall 18 and is forced outwardly by the dispersal cone 38. The angle of the sides of the inverted cone are the same as the angle of the upper part of the hopper, typically 75°±. The height of the cone is a function of the largest diameter of the hopper. The diameter of the lowest edge of the inverted cone is typically 50% of the diameter of the hopper in the region where it is located. The spacing between the bottom edge of the cone and the adjacent hopper wall is large enough to allow passage of the largest pieces of material which are to pass through the unit. This is a spacing of approximately 10″ which has been found adequate to handle sporodically experienced brick bats or large coating accumulations. The 50% diameter and ten inch dimension also serve to determine the elevation of the assembly in the hopper. A mated underlying frustoconical section 44 joined to the bottom of the dispersal cone 38 guides the draw further along the hopper wall 18 or, if desired, along hopper wall 19 as well, by extending it slightly lower into section 19. The wall of the lower frustoconical section 44 is generally parallel to the wall portion of the hopper and forms an annular inclined particle flow passageway which acts to keep the flow uniform therein.

FIGS. 4, 5 and 6 illustrate prior art square hoppers 47 such as are described for use in shaft type particle coolers of my prior U.S. Pat. No. 3,578,297 and which present non-uniform sloped flow paths and non-uniform areas to the particles flowing downwardly and thus cause imbalance in the A/P ratios therethrough. FIG. 4 shows a square upper portion 48 diminishing in cross-sectional area as particles flow downward to a lower square hopper portion 49 which also diminishes in area as particles flow downwardly to the hopper exit at the standpipe 50. An air gap 51 is provided between the upper and lower square hopper portions 48 and 49 through which air is introduced from a surrounding plenum (not shown) to the bed of particles.

FIGS. 5 and 6 are cross-sectional views of the hopper 47 as taken on lines 5—5 through the wall 48, and on line 6—6 through a corner of the hopper, respectively. These figures illustrate the different angles and path lengths presented to particles flowing in each of these profile regions of the same hopper. The angle of the wall portions 48 and 49, midway between corners of the hopper as shown in FIG. 5 are significantly steeper and shorter than the corner valley angles and paths, respectively, of the wall portions 48*a* and 49*a* shown in FIG. 6. The areas in plan view of 22½°, 45° or 90° sections about a vertical centerline of each hopper is also significantly different. The particles flowing downward in these different zones of the same hopper therefore descend at significantly different rates. Air being blown upwardly under pressure is correspondingly presented considerably different masses of product because differences in path lengths, slope of the sides and area in cross-section in the illustrated regions, all contribute to non-uniformities in rate of particle descent, and thus in air/product ratios, resulting in undesired differences in cooling of particles in different parts of such prior art configurations.

FIG. 7 illustrates more clearly the overall assembly of two hoppers 17 of the cluster of four hoppers represented in FIG. 1. The figure shows how vertically faced flow displacer corner segments 27 and projecting displacer segments 28 generally of triangular shape in the cooler shaft walls 26 provide in outline, part of a partially octagonal shaped cross-section above each hopper in chamber 12 which without such displacer segments would otherwise be square or rectangular in cross-section. The refractory displacer segments are supported by an assembly of wide flange beams 40 on which the hoppers 17 are in part supported and stabilized. Each of the scallops 22, except for those that are contiguous to scallops of adjacent hoppers, has an associated overhang portion such as an overhang 44 formed in or suitably secured to the upper edge of a scallop 22 such as by being welded thereto. As shown in FIG. 8 the overhang portion 44 engages the upper edge of an upper flange 42 of a wide flange beam 40 which beam also has a lower flange 43 and a web 41. In the corners and mid region under refractory segments of the externally rectangular cooling shaft the overhang portions associated with the respective scallops 22 is a broader corner plate 45 provided to support refractory segments 27 as shown in FIG. 9 and mid-region segments 28, respectively.

As an alternate to the displacer segments 27 and 28 shown in FIG. 7, slanted triangular refractory or metal displacers 77 and 78, shown in dotted lines in FIG. 7, can be utilitzed in which the displacers extend from the top edge of the hopper scallops up to an apex at the wall of a rectangular or square shaft. More specifically, as shown in FIG. 7, the corner displacer 77 extends from a base at the scallop up into mergered relation with the corner wall portions of the refractory shaft, the slant having the same angle to horizontal as the steep angled wall of the hopper 17.

In the mid-region between corners the displacer 78 has two faces each extending up at the same angle as the hopper wall 18 from the top straight edge of a scallop of each of a pair of adjacent hoppers respectively, reaching an apex against the flat wall of the cooler shaft. The mass flow of material is thus downwardly in the vertical portion of the shaft 12 until it reaches a level of the displacers which causes it to converge to the hoppers where the octagonal configuration at the upper border of the hopper is converted to its circular conical configuration. Thus the gradual change from rectangular to circular is met by the material with minimal divergences in paths.

FIG. 11 illustrates another form of the dual angled hoppers of the present invention in which refractory corner segments and mid-wall segments of the externally rectangular cooling shaft or chamber are not present. The hoppers 57 instead are provided upward extensions 67 of the steep angled upper wall portions 58 of the hopper 57 which extend up as a continuation of the steep wall from between adjacent scallops 62 until they join the corner of walls 56 of the cooling chamber or join a matching extension 67 of an adjacent hopper to thus form a composite extension 68 which in turn merges with the flat mid-region portion of the wall 56 or with like extensions from four contiguous hoppers at the center of the cooler.

Each of the hoppers 57, beside its steep wall portion 58, has a shallower angled wall portion 59 leading to a discharge standpipe 60. Four slots 63 in the wall 58 provide for passage therethrough of air ducts (not shown) similar to the arrangement of air ducts in FIG. 2. By this alternate arrangement a smooth transitory flow of particles downward to the hopper is facilitated. Where the more desirable partial octagonal shaft shape of the previous figures presents difficulty to adopt, such as because of material used and space limitations, this embodiment sacrifices the advantages of equal segmental areas of withdrawal within the cooling shaft and the top of the hoppers, but retains all other design advantages and has the additional advantage of providing a greater internal area for a given sized external dimension and refractory thickness.

In view of the foregoing, while the invention has been described with regard to the illustrated embodiments, it will be recognized that my invention is not limited specifically to the particular arrangements shown and described, and accordingly, by the appended claims all modifications, adaptations and arrangements thereof are contemplated which fall within the spirit and scope of the invention.

I claim:

1. Apparatus for cooling hot particulate material comprising in combination a kiln from which such hot particulate material is supplied, a cooling shaft positioned in association with said kiln for continuous receipt and containment of a bed of such hot particulate material, a hopper underlying said cooling shaft for flow therethrough of particulate material of said bed to a lower discharge outlet of the hopper, said hopper comprising a circular upper uniformly sloped steep wall section and an associated circular lower uniformly sloped shallower wall section leading to said outlet, flow guiding means centrally located in a position in a range extending from within said upper steep wall section and immediately above forming an annular passageway to cause said material to flow adjacent the wall of said steep wall section upon passage to said shallower section and air supply means for supplying cooling air under pressure to said hopper to force said air upwardly in said bed in sufficient amount to cool said particles to an acceptable handling temperature upon discharge from said outlet.

2. Apparatus according to claim 1 in which said flow guiding means comprises a centrally located frustoconical section within said steep wall section with its smallest diameter toward said outlet, the wall of said frustoconical section being generally parallel to the adjacent steep wall of said hopper.

3. Apparatus according to claim 1 in which said flow guiding means include a flow dispersing conical section mated at its broadest dimension to the top of said frustoconical section to channel the downward flow of material radially outward in said hopper toward said annular passageway.

4. Apparatus for cooling hot particulate material as set forth in claim 3 in which said steel wall section of said hopper has a uniformly sloped angular inclination greater than 70° to the horizontal.

5. Apparatus for cooling hot particulate material as set forth in claim 3 in which said steep wall section of said hopper has a uniform angle of 75°±5° to the horizontal.

6. Apparatus for cooling hot particulate material as set forth in claim 5 in which said shallower wall section has a uniform angle of 55°±5° to the horizontal.

7. Apparatus for cooling hot particulate material as set forth in claim 1 in which the cooling shaft for containing the bed of particles is square in cross-sectional shape formed of flat vertical side walls and in which the steep wall section of the hopper has projections extending upwardly therefrom at the same steep angle as said upper hopper wall section into a merged relation with both sides of each adjacent corner region of said shaft to promote substantially uniform downward flow in cross-section of the mass of particles in said vertical shaft to the discharge outlet of said hopper.

8. Apparatus for cooling hot particulate material as set forth in claim 7 in which said hopper is one of a cluster of four such hoppers and in which each hopper also has a projection extending upward at the same steep angle into a mated relation with a corresponding projection of an immediately adjacent hopper as well as in merged relation with an adjacent side wall portion of said shaft in the mid-region between a pair of corners of said shaft.

9. Apparatus for cooling particulate material as set forth in claim 8 in which each said hopper has one of its projections extending upwardly in the center of said cluster for a mated relation with similar projections of the other three hoppers of said cluster.

10. Apparatus for cooling hot particles as set forth in claim 4 in which said cooling shaft is rectangular or square in shape and more than one such hopper is associated therewith, said hoppers each having upward extensions from its upper steep walled conical section extending at the same steep angle and reaching into and merging with corner wall portions of said cooling shaft and other similar upward extensions from said upper steep walled conical section reaching into mated relation with a corresponding extension of an adjacent hopper and in merged association with an immediately adjacent cooler shaft wall portion.

* * * * *